US009786235B2

(12) United States Patent
He et al.

(10) Patent No.: US 9,786,235 B2
(45) Date of Patent: Oct. 10, 2017

(54) PIXEL STRUCTURE HAVING OPPOSITE SUB-PIXEL POLARITIES IN ADJACENT PIXEL COLUMNS AND LIQUID CRYSTAL DISPLAY PANEL HAVING SAME

(71) Applicant: Shenzhen China Star Optoelectronics Technology Co., Ltd., Shenzhen (CN)

(72) Inventors: Tao He, Shenzhen (CN); Jhenwei He, Shenzhen (CN); Wenqin Zhao, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 14/771,209

(22) PCT Filed: Jun. 29, 2015

(86) PCT No.: PCT/CN2015/082665
§ 371 (c)(1),
(2) Date: Aug. 28, 2015

(87) PCT Pub. No.: WO2016/201724
PCT Pub. Date: Dec. 22, 2016

(65) Prior Publication Data

US 2016/0365047 A1 Dec. 15, 2016

(30) Foreign Application Priority Data

Jun. 15, 2015 (CN) ..... 2015 1 0330249

(51) Int. Cl.
*G09G 3/36* (2006.01)

(52) U.S. Cl.
CPC ..... *G09G 3/3614* (2013.01); *G09G 3/3607* (2013.01); *G09G 2300/0452* (2013.01); *G09G 2320/0209* (2013.01)

(58) Field of Classification Search
None
See application file for complete search history.

(56) References Cited

U.S. PATENT DOCUMENTS

| | | | | |
|---|---|---|---|---|
| 2009/0040243 | A1* | 2/2009 | Hisada | G09G 3/3614 345/690 |
| 2015/0161927 | A1* | 6/2015 | Hekstra | G09G 3/3614 345/209 |
| 2015/0170590 | A1* | 6/2015 | Ahn | G09G 3/3614 345/96 |

* cited by examiner

*Primary Examiner* — Liliana Cerullo
*Assistant Examiner* — Donna Lui
(74) *Attorney, Agent, or Firm* — Leong C. Lei

(57) ABSTRACT

The present invention provides a pixel structure and a liquid crystal display panel. The pixel structure comprises a plurality of pixel units arranged in array, and each pixel unit comprises a white sub pixel (W), a red sub pixel (R), a green sub pixel (G) and a blue sub pixel (B); in respective pixel units, the white sub pixel (W), the red sub pixel (R), the green sub pixel (G) and the blue sub pixel (B) are aligned with the same order along a horizontal direction; a driving mode of the pixel structure is row inversion; as showing an image of the same frame, in pixel units of each column, polarities of sub pixels of every two adjacent columns are opposite; in the sub pixels of every two adjacent columns, polarities of sub pixels of the same color are opposite to make that polarities of every two adjacent sub pixels of the same color in the pixel units of the same row are opposite. It is capable of reducing the horizontal crosstalk of the sub pixels of the same color in the pixel units of the same row to ensure the image display effect.

9 Claims, 4 Drawing Sheets

| | | | | | | | | | | | | | | | |
|---|---|---|---|---|---|---|---|---|---|---|---|---|---|---|---|
| W + | R − | G + | B − | W + | R − | G + | B − | W + | R − | G + | B − | W + | R − | G + | B − |
| W + | R − | G + | B − | W + | R − | G + | B − | W + | R − | G + | B − | W + | R − | G + | B − |
| W + | R − | G + | B − | W + | R − | G + | B − | W + | R − | G + | B − | W + | R − | G + | B − |
| W + | R − | G + | B − | W + | R − | G + | B − | W + | R − | G + | B − | W + | R − | G + | B − |
| ⋮ | | | | | | | | | | | | | | | |

Fig. 1 (Prior Art)

| | | | | | | | | | | | | | | | |
|---|---|---|---|---|---|---|---|---|---|---|---|---|---|---|---|
| W + | R − | G + | B − | W − | R + | G − | B + | W + | R − | G + | B − | W − | R + | G − | B + |
| W + | R − | G + | B − | W − | R + | G − | B + | W + | R − | G + | B − | W − | R + | G − | B + |
| W + | R − | G + | B − | W − | R + | G − | B + | W + | R − | G + | B − | W − | R + | G − | B + |
| W + | R − | G + | B − | W − | R + | G − | B + | W + | R − | G + | B − | W − | R + | G − | B + |
| ⋮ | | | | | | | | | | | | | | | |

Fig. 3

PIXEL STRUCTURE HAVING OPPOSITE SUB-PIXEL POLARITIES IN ADJACENT PIXEL COLUMNS AND LIQUID CRYSTAL DISPLAY PANEL HAVING SAME

FIELD OF THE INVENTION

The present invention relates to a display technology field, and more particularly to a pixel structure and a liquid crystal display panel.

BACKGROUND OF THE INVENTION

The Liquid Crystal Display (LCD), Organic Light Emitting Diode (OLED) and other panel display devices have become the major production in the present display device market.

The display panel is an important component of the LCD, OLED and other panel display devices. For the LCD, the structure of the liquid crystal display panel generally comprises a Color Filter (CF), a Thin Film Transistor Array Substrate (TFT Array Substrate), and a Liquid Crystal Layer arranged between the two substrates. The working principle is that the light of backlight module is reflected to generate images by applying driving voltages to the two glass substrate for controlling the rotations of the liquid crystal molecules.

The traditional liquid crystal display panel comprises a plurality of pixels alignment in array, and each pixel comprises a red (R), a green (G), a blue (B), three sub pixels. The R, G, B color filters utilized in prior art are all absorption type color resists. When the light is incoming, only the light of corresponding color can permeate, the lights of other two colors are both absorbed, which make the transmission of the display panel is lower. Therefore, the display technology of forming red, green, blue, white, four sub pixels in one pixel appears. The color resist layer is not added to the W sub pixel. By controlling the corresponding gray scale to manipulate the light transmittance of the W sub pixel. The light transmittance of the display panel can be promoted to reduce the backlight power consumption, lower the cost for energy conservation and environment protection. Accordingly, the WRGB technology draws more and more attentions, and the demands to the WRGB technology gets higher and higher. The liquid crystal display panel utilizing the WRGB technology requires better experience effect to promote the image quality.

FIG. 1 shows a liquid crystal display panel utilizing WRGB technology according to prior art. The liquid crystal display panel of prior art utilizes a row inversion driving mode, and comprises a plurality of pixel units arranged in array, and each pixel unit comprises a white sub pixel W, a red sub pixel R, a green sub pixel G and a blue sub pixel B. In respective pixel units, the alignment orders of the white sub pixel W, the red sub pixel R, the green sub pixel G and the blue sub pixel B are the same. FIG. 1 shows that the white sub pixel W, the red sub pixel R, the green sub pixel G and the blue sub pixel B are sequentially aligned from left to right along a horizontal direction in one pixel unit. As showing an image of the same frame, regarding of the pixel units of each column, the polarities of sub pixels of every two adjacent columns are opposite; for the sub pixels of every two adjacent columns, the polarities of the sub pixels of the same color are opposite; for the pixel units of each row, the polarities of the sub pixels of the same color are the same. FIG. 1 shows that in sub pixels of the same row, the polarities of all the white sub pixels are positive, and the polarities of all the red sub pixels are negative, the polarities of all the green sub pixels are positive and the polarities of all the blue sub pixels are negative. Please refer to FIG. 2. The red sub pixel R is illustrated. Supposing that all red sub pixels R in the pixel units of one row is lighted, and the sub pixels of other colors went dark, all the red sub pixels R in the pixel units of the row in FIG. 1 have negative polarity. The couple to the common electrode cannot cancel out each other. The common electrode is pulled and the horizontal crosstalk is extremely easy to be caused to influence the image display effect.

SUMMARY OF THE INVENTION

An objective of the present invention is to provide a pixel structure, capable of reducing the horizontal crosstalk of the sub pixels of the same color in the pixel units of the same row to ensure the image display effect.

Another objective of the present invention is to provide a liquid crystal display panel, of which the horizontal crosstalk of the sub pixels of the same color in the pixel units of the same row is low and the image display effect is fine.

For realizing the aforesaid objectives, the present invention provides a pixel structure, comprising a plurality of pixel units arranged in array, and each pixel unit comprises a white sub pixel, a red sub pixel, a green sub pixel and a blue sub pixel; in respective pixel units, the white sub pixel, the red sub pixel, the green sub pixel and the blue sub pixel are aligned with the same order along a horizontal direction;

a driving mode of the pixel structure is row inversion; as showing an image of the same frame, in pixel units of each column, polarities of sub pixels of every two adjacent columns are opposite; in the sub pixels of every two adjacent columns, polarities of sub pixels of the same color are opposite to make that polarities of every two adjacent sub pixels of the same color in the pixel units of the same row are opposite.

As showing a pure color image of the same frame, the polarities of every two adjacent sub pixels which have the same color as the showing image in the pixel units of the same row cancel out each other.

In respective pixel units, the white sub pixel, the red sub pixel, the green sub pixel and the blue sub pixel are sequentially aligned from left to right along a horizontal direction.

As showing an image of the same frame, in pixel units of every two adjacent columns, wherein in pixel units of one column, the white sub pixel has positive polarity, and the red sub pixel has negative polarity, and the green sub pixel has positive polarity, and the blue sub pixel has negative polarity, and in pixel units of the other column, the white sub pixel has negative polarity, and the red sub pixel has positive polarity, and the green sub pixel has negative polarity, and the blue sub pixel has positive polarity.

The present invention further provides a liquid crystal display panel, comprising a plurality of pixel units arranged in array, and each pixel unit comprises a white sub pixel, a red sub pixel, a green sub pixel and a blue sub pixel; in respective pixel units, the white sub pixel, the red sub pixel, the green sub pixel and the blue sub pixel are aligned with the same order along a horizontal direction;

the liquid crystal display panel is a liquid crystal display panel of a row inversion driving mode; as showing an image of the same frame, in pixel units of each column, polarities of sub pixels of every two adjacent columns are opposite; in the sub pixels of every two adjacent columns, polarities of sub pixels of the same color are opposite to make that polarities of every two adjacent sub pixels of the same color in the pixel units of the same row are opposite.

As showing a pure color image of the same frame, the polarities of every two adjacent sub pixels which have the same color as the showing image in the pixel units of the same row cancel out each other.

In respective pixel units, the white sub pixel, the red sub pixel, the green sub pixel and the blue sub pixel are sequentially aligned from left to right along a horizontal direction.

As showing an image of the same frame, in pixel units of every two adjacent columns, wherein in pixel units of one column, the white sub pixel has positive polarity, and the red sub pixel has negative polarity, and the green sub pixel has positive polarity, and the blue sub pixel has negative polarity, and in pixel units of the other column, the white sub pixel has negative polarity, and the red sub pixel has positive polarity, and the green sub pixel has negative polarity, and the blue sub pixel has positive polarity.

The present invention further provides a liquid crystal display panel, comprising a plurality of pixel units arranged in array, and each pixel unit comprises a white sub pixel, a red sub pixel, a green sub pixel and a blue sub pixel; in respective pixel units, the white sub pixel, the red sub pixel, the green sub pixel and the blue sub pixel are aligned with the same order along a horizontal direction;

the liquid crystal display panel is a liquid crystal display panel of a row inversion driving mode; as showing an image of the same frame, in pixel units of each column, polarities of sub pixels of every two adjacent columns are opposite; in the sub pixels of every two adjacent columns, polarities of sub pixels of the same color are opposite to make that polarities of every two adjacent sub pixels of the same color in the pixel units of the same row are opposite;

wherein as showing a pure color image of the same frame, the polarities of every two adjacent sub pixels which have the same color as the showing image in the pixel units of the same row cancel out each other;

wherein in respective pixel units, the white sub pixel, the red sub pixel, the green sub pixel and the blue sub pixel are sequentially aligned from left to right along a horizontal direction;

wherein as showing an image of the same frame, in pixel units of every two adjacent columns, wherein in pixel units of one column, the white sub pixel has positive polarity, and the red sub pixel has negative polarity, and the green sub pixel has positive polarity, and the blue sub pixel has negative polarity, and in pixel units of the other column, the white sub pixel has negative polarity, and the red sub pixel has positive polarity, and the green sub pixel has negative polarity, and the blue sub pixel has positive polarity.

The benefits of the present invention are: the present invention provides a pixel structure and a liquid crystal display panel utilizing a row inversion driving mode, and in pixel units of each column, polarities of sub pixels of every two adjacent columns are opposite; in the sub pixels of every two adjacent columns, polarities of sub pixels of the same color are opposite to make that polarities of every two adjacent sub pixels of the same color in the pixel units of the same row are opposite. It is capable of reducing the horizontal crosstalk of the sub pixels of the same color in the pixel units of the same row to ensure the image display effect.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution and the beneficial effects of the present invention are best understood from the following detailed description with reference to the accompanying figures and embodiments.

In drawings,

FIG. 1 is an alignment diagram of polarities of sub pixels in a liquid crystal display panel utilizing WRGB technology according to prior art;

FIG. 3 is an alignment diagram of polarities of sub pixels in a pixel structure according to the present invention;

DETAILED DESCRIPTION OF PREFERRED EMBODIMENTS

Figure 2:
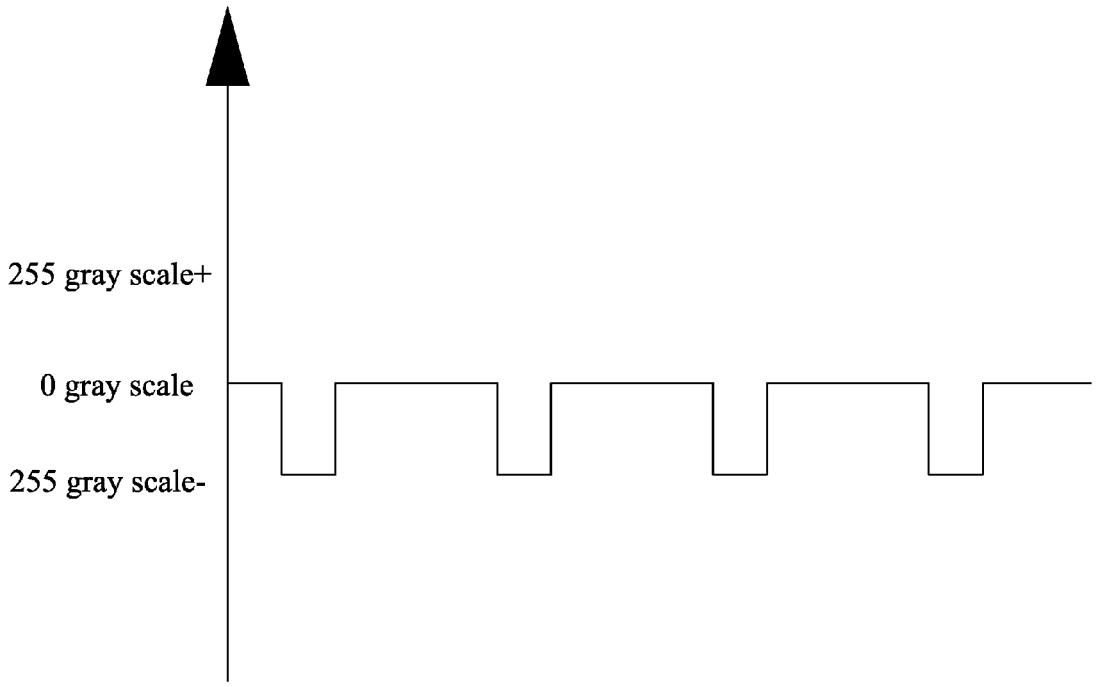
Fig. 2 (Prior Art)
FIG. 2 is a polarity diagram as only red sub pixels in the pixel units of one row shown in FIG. 1 are full lighted.

For better explaining the technical solution and the effect of the present invention, the present invention will be further described in detail with the accompanying drawings and the specific embodiments.

Please refer to FIG. 3. The present invention first provides a pixel structure, comprising a plurality of pixel units arranged in array, and each pixel unit comprises a white sub pixel W, a red sub pixel R, a green sub pixel G and a blue sub pixel B. In respective pixel units, the white sub pixel W, the red sub pixel R, the green sub pixel G and the blue sub pixel B are aligned with the same order along a horizontal direction.

a driving mode of the pixel structure is row inversion; as showing an image of the same frame, in pixel units of each column, polarities of sub pixels of every two adjacent columns are opposite; in the sub pixels of every two adjacent columns, polarities of sub pixels of the same color are opposite to make that polarities of every two adjacent sub pixels of the same color in the pixel units of the same row are opposite.

Significantly, as long as the white sub pixel W, the red sub pixel R, the green sub pixel G and the blue sub pixel B are aligned with the same order, the present invention does not have to specify the alignment order of the white sub pixel W, the red sub pixel R, the green sub pixel G and the blue sub pixel B in one pixel unit. That is to say, according to the formula calculation of the possible alignment combination, the alignment order of the white sub pixel W, the red sub pixel R, the green sub pixel G and the blue sub pixel B can be determined in any way of 24 kinds of the possible alignment combination.

Preferably, as shown in FIG. 3, in respective pixel units, the white sub pixel W, the red sub pixel R, the green sub pixel G and the blue sub pixel B are sequentially aligned from left to right along a horizontal direction. As showing an image of the same frame, in pixel units of every two adjacent columns, wherein in pixel units of one column, the white sub pixel W has positive polarity, and the red sub pixel R has negative polarity, and the green sub pixel G has positive polarity, and the blue sub pixel B has negative polarity, and in pixel units of the other column, the white sub pixel W has negative polarity, and the red sub pixel R has positive polarity, and the green sub pixel G has negative polarity, and the blue sub pixel B has positive polarity. Under such circumstance, as regarding the pixel units of the same row, the polarities of every two adjacent white sub pixels are opposite, and the polarities of every two adjacent red sub pixels are opposite, and the polarities of every two adjacent green sub pixels are opposite, and the polarities of every two adjacent blue sub pixels are opposite, too. In comparison with prior art, the polarities of every two adjacent sub pixels of the same color in the pixel units of the same row are opposite, and thus the coupling to the common electrode is weakened. The degree of pulling the common electrode descends and the horizontal crosstalk is correspondingly reduced.

Figure 4:
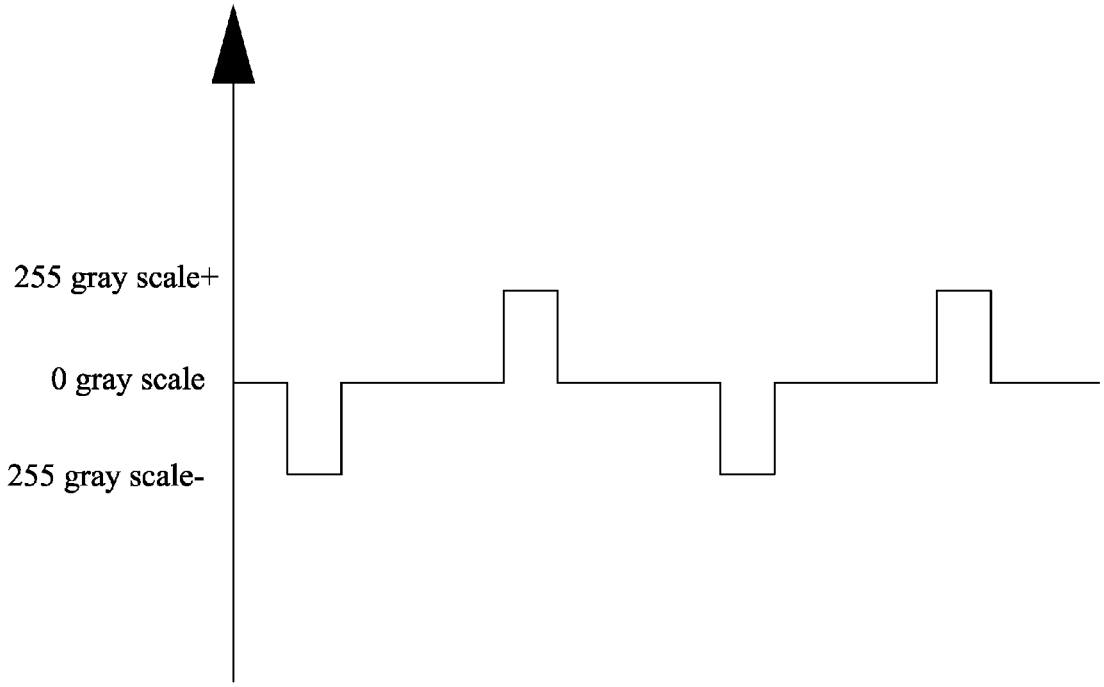
FIG. 4 is a polarity diagram as only red sub pixels in the pixel units of one row shown in FIG. 3 are full lighted.

As showing a pure color image of the same frame, the polarities of every two adjacent sub pixels which have the same color as the showing image in the pixel units of the same row cancel out each other. Showing a pure red image of the same frame is illustrated. All red sub pixels R in the pixel units of one row is lighted, and the sub pixels of other colors went dark. As shown in FIG. 4, the polarities of every two adjacent red sub pixels cancel out each other, and the coupling to the common electrode is weakened, too. The common electrode is almost no pulled. Therefore, the horizontal crosstalk can be significantly reduced to ensure the image display effect.

The present invention further provides a liquid crystal display panel, and the liquid crystal display panel utilizes a row inversion driving mode, which comprises the pixel structure as shown in the aforesaid FIG. 3. The description of the pixel structure is not repeated here. As the liquid crystal display panel shows the image of the same frame, polarities of every two adjacent sub pixels of the same color in the pixel units of the same row are opposite. It is capable of reducing the horizontal crosstalk of the sub pixels of the same color in the pixel units of the same row to ensure the image display effect.

In conclusion, the pixel structure and the liquid crystal display panel of the present invention utilizes a row inversion driving mode, and in pixel units of each column, polarities of sub pixels of every two adjacent columns are opposite; in the sub pixels of every two adjacent columns, polarities of sub pixels of the same color are opposite to make that polarities of every two adjacent sub pixels of the same color in the pixel units of the same row are opposite. It is capable of reducing the horizontal crosstalk of the sub pixels of the same color in the pixel units of the same row to ensure the image display effect.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A pixel structure, comprising a plurality of pixel units arranged in an array, and each pixel unit comprising a white sub pixel, a red sub pixel, a green sub pixel and a blue sub pixel; in respective pixel units, the white sub pixel, the red sub pixel, the green sub pixel and the blue sub pixel being aligned with the same order along a horizontal direction;

wherein a driving mode of the pixel structure is row inversion; in showing an image of the same frame, pixel units of columns extending in a vertical direction are arranged such that each column of pixel units comprises four columns of sub-pixels and polarities of sub pixels of every two adjacent columns of the sub-pixels are opposite; and in every two adjacent columns of pixel units, polarities of sub pixels of the same color are opposite such that polarities of every two adjacent sub pixels of the same color in the pixel units of the same row are opposite; and wherein in each column of pixel units, each column of sub-pixels comprises only sub-pixels of the same color and same polarity, while every two adjacent ones of the columns of sub-pixels in each column of pixel unit respectively have sub-pixels of different colors and opposite polarities.

2. The pixel structure according to claim 1, wherein as showing a pure color image of the same frame, the polarities of every two adjacent sub pixels which have the same color as the showing image in the pixel units of the same row cancel out each other.

3. The pixel structure according to claim 1, wherein in respective pixel units, the white sub pixel, the red sub pixel, the green sub pixel and the blue sub pixel are sequentially aligned from left to right along a horizontal direction.

4. The pixel structure according to claim 3, wherein as showing an image of the same frame, in pixel units of every two adjacent columns, wherein in pixel units of one column, the white sub pixel has positive polarity, and the red sub pixel has negative polarity, and the green sub pixel has positive polarity, and the blue sub pixel has negative polarity, and in pixel units of the other column, the white sub pixel has negative polarity, and the red sub pixel has positive polarity, and the green sub pixel has negative polarity, and the blue sub pixel has positive polarity.

5. A liquid crystal display panel, comprising a plurality of pixel units arranged in an array, and each pixel unit comprising a white sub pixel, a red sub pixel, a green sub pixel and a blue sub pixel; in respective pixel units, the white sub pixel, the red sub pixel, the green sub pixel and the blue sub pixel being aligned with the same order along a horizontal direction;

wherein the liquid crystal display panel is a liquid crystal display panel of a row inversion driving mode; in showing an image of the same frame, pixel units of columns extending in a vertical direction are arranged such that each column of pixel units comprises four columns of sub-pixels and polarities of sub pixels of every two adjacent columns of the sub-pixels are opposite; and in every two adjacent columns of pixel units, polarities of sub pixels of the same color are opposite such that polarities of every two adjacent sub pixels of the same color in the pixel units of the same row are opposite; and wherein in each column of pixel units, each column of sub-pixels comprises only sub-pixels of the same color and same polarity, while every two adjacent ones of the columns of sub-pixels in each column of pixel unit respectively have sub-pixels of different colors and opposite polarities.

6. The liquid crystal display panel according to claim 5, wherein as showing a pure color image of the same frame, the polarities of every two adjacent sub pixels which have the same color as the showing image in the pixel units of the same row cancel out each other.

7. The liquid crystal display panel according to claim 5, wherein in respective pixel units, the white sub pixel, the red sub pixel, the green sub pixel and the blue sub pixel are sequentially aligned from left to right along a horizontal direction.

8. The liquid crystal display panel according to claim 7, wherein as showing an image of the same frame, in pixel units of every two adjacent columns, wherein in pixel units of one column, the white sub pixel has positive polarity, and the red sub pixel has negative polarity, and the green sub pixel has positive polarity, and the blue sub pixel has negative polarity, and in pixel units of the other column, the white sub pixel has negative polarity, and the red sub pixel has positive polarity, and the green sub pixel has negative polarity, and the blue sub pixel has positive polarity.

9. A liquid crystal display panel, comprising a plurality of pixel units arranged in an array, and each pixel unit comprising a white sub pixel, a red sub pixel, a green sub pixel and a blue sub pixel; in respective pixel units, the white sub pixel, the red sub pixel, the green sub pixel and the blue sub pixel being aligned with the same order along a horizontal direction;

wherein the liquid crystal display panel is a liquid crystal display panel of a row inversion driving mode; in showing an image of the same frame, pixel units of columns extending in a vertical direction are arranged such that each column of pixel units comprises four columns of sub-pixels and polarities of sub pixels of every two adjacent columns of the sub-pixels are opposite; and in every two adjacent columns of pixel units, polarities of sub pixels of the same color are opposite such that polarities of every two adjacent sub pixels of the same color in the pixel units of the same row are opposite; and wherein in each column of pixel units, each column of sub-pixels comprises only sub-pixels of the same color and same polarity, while every two adjacent ones of the columns of sub-pixels in each column of pixel unit respectively have sub-pixels of different colors and opposite polarities;

wherein as showing a pure color image of the same frame, the polarities of every two adjacent sub pixels which have the same color as the showing image in the pixel units of the same row cancel out each other;

wherein in respective pixel units, the white sub pixel, the red sub pixel, the green sub pixel and the blue sub pixel are sequentially aligned from left to right along a horizontal direction;

wherein as showing an image of the same frame, in pixel units of every two adjacent columns, wherein in pixel units of one column, the white sub pixel has positive polarity, and the red sub pixel has negative polarity, and the green sub pixel has positive polarity, and the blue sub pixel has negative polarity, and in pixel units of the other column, the white sub pixel has negative polarity, and the red sub pixel has positive polarity, and the green sub pixel has negative polarity, and the blue sub pixel has positive polarity.

* * * * *